United States Patent [19]

Liermann et al.

[11] Patent Number: 4,478,131

[45] Date of Patent: Oct. 23, 1984

[54] ELECTRO-PNEUMATIC DOOR CONTROL APPARATUS

[75] Inventors: Peter Liermann, Barsinghausen; Karl-Heinz Hesse, Gehrden; Dietmar Meyer, Barsinghausen; Wolfgang Gudat, Hanover, all of Fed. Rep. of Germany

[73] Assignee: WABCO Fahrzeugbremsen GmbH, Hanover, Fed. Rep. of Germany

[21] Appl. No.: 295,393

[22] Filed: Aug. 24, 1981

[30] Foreign Application Priority Data

Aug. 29, 1980 [DE] Fed. Rep. of Germany ..... 3032516

[51] Int. Cl.[3] ..... F15B 11/15; F15B 13/044; F15B 15/20

[52] U.S. Cl. ..... 91/356; 91/392; 91/433; 91/448; 91/453; 91/459; 180/271

[58] Field of Search ..... 91/433, 356, 318, 448, 91/459, 451, 453, 392, 400; 49/26, 28, 27, 31, 199; 137/596.17; 180/271; 105/341, 343

[56] References Cited

U.S. PATENT DOCUMENTS

| | | | |
|---|---|---|---|
| 2,578,810 | 12/1951 | Kilar et al. | 91/356 X |
| 3,003,317 | 10/1961 | Schroeder et al. | 49/26 |
| 3,828,698 | 8/1974 | Delamater et al. | 49/28 |
| 3,916,567 | 11/1975 | Daugirdas | 49/28 |
| 3,922,814 | 12/1975 | Runft | 49/28 |
| 3,943,972 | 3/1976 | Bitonti et al. | 137/596.17 |
| 4,134,231 | 1/1979 | Daugirdas et al. | 49/26 |
| 4,263,746 | 4/1981 | Eller et al. | 49/28 |

FOREIGN PATENT DOCUMENTS

| | | | |
|---|---|---|---|
| 715427 | 8/1965 | Canada | 49/26 |
| 774457 | 12/1967 | Canada | 49/26 |

*Primary Examiner*—Robert E. Garrett
*Assistant Examiner*—Abram McConnell Bradley, IV
*Attorney, Agent, or Firm*—R. S. Visk

[57] ABSTRACT

An electro-pneumatic door control apparatus for use on public vehicles and including reversing mechanism for changing the direction of door movement, either automatically or operator-initiated, in the event of an obstruction in the door. The control apparatus further includes a flip-flop for recording the position (either open or closed) of the door at all times, a monitoring logic device for recognizing the position of the flip-flop and what type of monitoring function is permitted, a control logic device for picking up the door command and the signal from the monitoring logic device combing them and transmitting them to a valve solenoid control device for energizing respective solenoids of several valve devices by which the appropriate movement of the doors is effected.

1 Claim, 2 Drawing Figures

ELECTRO-PNEUMATIC DOOR CONTROL APPARATUS

BACKGROUND OF THE INVENTION

Door controls of this type are mainly used in public vehicles, for example buses, which serve public transportation. The controls are mostly operated pneumatically or electro-pneumatically, that means, the driver releases respective pneumatic or electro-pneumatic impulses for opening or closing the door, which impulses act upon a door control apparatus comprising a door cylinder operable by compressed air supplied via a door valve designed as a control valve. Thus, the stroke movement of the door cylinder piston initiates the opening and closing movements of the door.

Due to the fact that various operational conditions have to be anticipated, especially unsafe actions by the passengers, the control operations must meet a number of limiting conditions. For example, it is generally required that the closing movement of a pneumatically operated vehicle door be automatically reversed to an opening movement when the closing door is jammed by people or objects. This also is applicable for complicated operating conditions which occur, i.e., during winter months when the kinematics of the door are affected by low temperatures, and when the closing movement of the door may be hindered by snow and ice. Since, during opening movement of the door, there also exists danger that people and objects may be caught therein, there should be additionally provided a device, such as an electro-pneumatic switching apparatus which would simply stop the door, by pressure release of the facility, rather than reverse it, because reverse movement of the door could represent a danger to the next person stepping through the same. Such an electro-pneumatic door control has been proposed in German Patent Application Nos. P 29 24 996.5 and P 29 28 801.5, not published. It became apparent, however, that the plurality of required limiting conditions could not be satisfied by standard electro-pneumatic means and could only be met with relatively high costs involved.

SUMMARY OF THE INVENTION

Thus, the object of the invention is to provide a door control apparatus of the type previously mentioned, which is capable of fulfilling all required limiting conditions in a simple manner and with low costs; that is, especially without the use of additional valves or pressure switches.

Briefly, the invention comprises fluid pressure (pneumatic) operable cylinder devices for operating the doors of the vehicle. Several solenoid-actuated valves control supply and release of pressure to and from the cylinders depending upon the direction of movement (opening or closing) of the doors when an obstruction to such movement occurs. Electronic means, including a flip-flop which records the position of the door at all times, a signal decoder, and a monitoring logic device transmits the signal to a control logic device which, in turn transmits the decoded signal to a valve solenoid control device for energizing the appropriate valve. The monitoring logic device also includes timing means for delaying automatic door action in the event that an operator-initiated action is effected.

DESCRIPTION AND OPERATION

Figure 1:
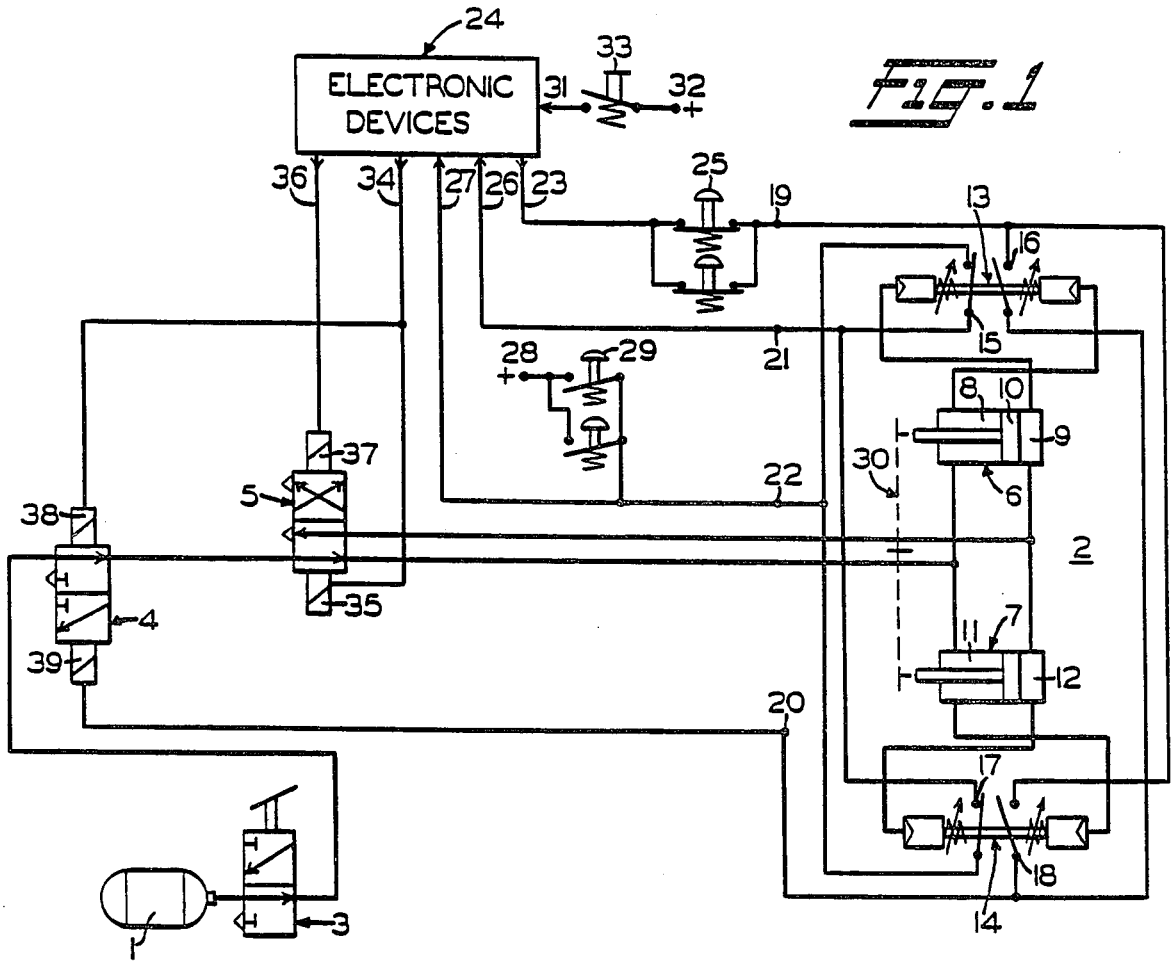
FIG. 1 is a diagrammatic view of an electro-pneumatic door control apparatus embodying the invention.

According to FIG. 1, a source of fluid under pressure 1, such as compressed air, is connected with a door operating control system 2 via an emergency valve device 3, a valve device 4, and a door valve device 5. The door control system 2 comprises operating cylinders 6 and 7 for operating respective sections of a door. Operating cylinder 6 has formed therein two opposing pressure chambers 8 and 9, as well as a piston 10 therebetween. Operating cylinder 7, with chambers 11 and 12, is installed accordingly. Chambers 8 and 9 of operating cylinder 6 are connected with inlets of a reversing switch device 13. Chambers 11 and 12 of operating cylinder 7 are connected to inlets of a reversing switch device 14 accordingly. Reversing switches 13 and 14 are provided with electric switch contacts 15 and 16, 17 and 18, respectively. Contacts 16 and 18 are in parallel relation, and are connected to connecting terminals 19 and 20. Contacts 15 and 17 are also in parallel relation, and are connected to connecting terminals 21 and 22. Connection terminal 19 is connected to a power outlet 23 of an electronic device 24 via a limit switch 25. Connection terminal 21 is connected to a power inlet 26 of electronic device 24. Connection terminal 22 is connected to a power inlet 27 of electronic device 24. Connection terminal 22 is further connected to an operating voltage source 28 via an additional limit switch 29. Both limit switches 25 and 29 are each provided with two parallel switch contacts associated with each one of two sections of a door 30 (represented symbolically by broken lines).

The electronic device 24 is further provided with a power inlet 31 which is connected to an operating voltage source 32 via a switch device 33. An additional power outlet 34 of the electronic device 24 is connected to a solenoid 35 for operating door valve 5 and to solenoid 38 of valve 4. Finally, a power outlet 36 of electronic device 24 is connected to a solenoid 37 for also operating door valve 5. Solenoid 39 of valve 4 is connected to terminal 20. Following is a description of the operation of the electro-pneumatic door control apparatus according to FIG. 1 which shows the device with a door in the closed position.

Normal reversal of closing movement of door 30 may be effected by the operator in usual manner by operating switch device 33 so that solenoid 35 of door valve 5 is energized and said valve reversed from the position shown, so that previously charged chambers 8 and 11 of the door cylinders 6 and 7 are vented via said valve 5. Pressurized fluid is then supplied to chambers 9 and 12 by valve 5.

If during the closing phase of door 30, an obstacle causes the door to jam, movement of the door must be reversed, that is, opened again. The presence of an obstacle is recognized in known fashion by the pressure gradient within the cylinder chambers 9 and 12, and signaled to the electronic device 24 by means of reversing switches 13 and 14. Electronic device 24, in turn transmits energy via outlet 34 to solenoid 35 of door valve device 5, and to a solenoid 38 of valve device 4, whereby the respective positions of said valve devices are reversed so that travel of the door is reversed from closing to opening.

Due to the fact that the door should not reverse itself when in the fully closed positions of the two sections, in spite of existing reversing conditions, two limit switches 25 and 29 are provided, through which the reversing command can be intercepted in said fully closed positions of the two door sections.

In case an obstacle becomes lodged, due to the rear edge of the door abutting thereagainst during opening operation, valve device 4 is actuated by a signal at the outlet 23 of the electronic device 24. This signal is transmitted via limit switch 25 and switching contacts 16 and 18 to an operating solenoid 39 of said valve device, so that the door cylinders 6 and 7 may thereby be vented.

Emergency valve device 3 is well known in pneumatic systems, and is shown in FIG. 1 as a two-position manual valve which vents or dumps all fluid pressure from the system regardless of the position of other valves in the system.

Figure 2:
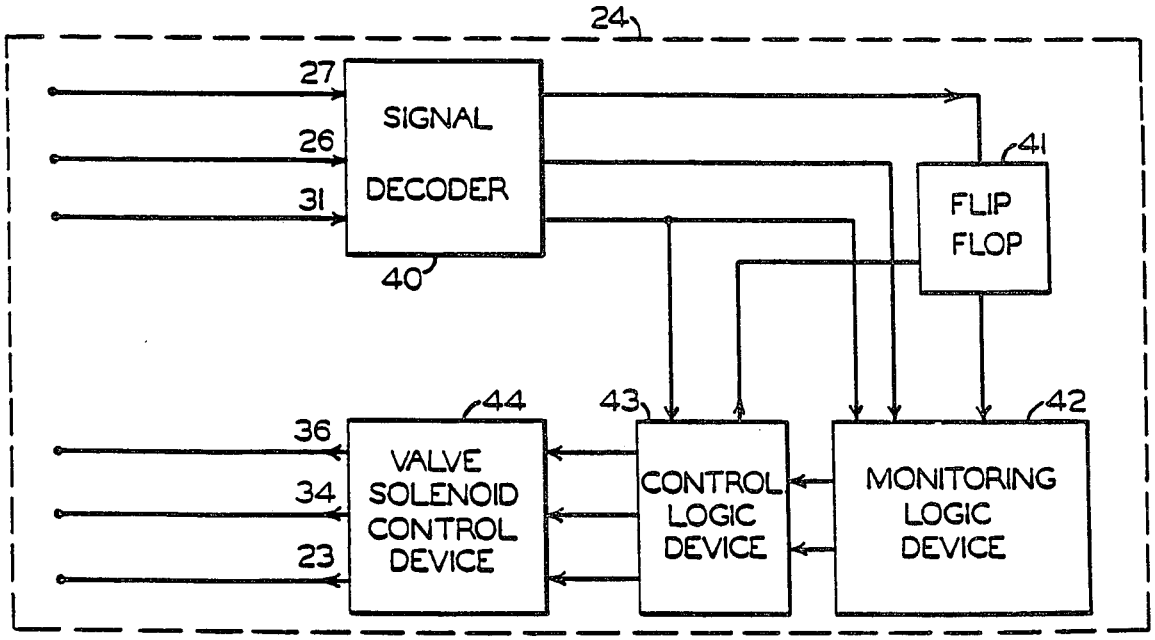
FIG. 2 is a schematic view of an electronic portion of the door control apparatus shown in FIG. 1.

FIG. 2 shows a block diagram of the electronic device 24 shown symbolically in FIG. 1. A signal decoder 4, with the inlet 27 is connected to the limit switch 29, while inlet 26 is connected to reversing switch connection terminals 21 and inlet 31 is connected to push button device 33. Signal decoder 40 accepts the signals of the connected switches or push buttons and coordinates them electronically with the voltage ratios, aided by an impedance, for example, an RC-combination and by a Schmitt-Trigger. A flip-flop 41 setting of the door simulates the respective door position. When switching on the electronic device 24, flip-flop 41 is preset according to the limit-switch-position, and following that is always controlled in combination with the door valve 5. Thus, the respective door position is stored in the flip-flop 41.

A monitoring logic device 42, from the position of the flip-flop 41 and the door command given by means of the push button device 33, recognizes whether or not or what type of monitoring function is permitted.

A control logic device 43 picks up the door command and the signal of the monitoring logic device 42, combines them, and transmits them to a valve solenoid control device 44.

Valve solenoid control device 44 contains output stages for operating the door valve 5 (outlet 34 and outlet 36). Furthermore, via outlet 23 and solenoid 39, valve 4 may be reversed.

A feature of the inverted door control is that the monitoring functions can be suppressed by a normal or maintained door command initiated by the operator via push button device 33. The door can thus be opened and closed at will even in case of a slowdown or a hindrance due to snow and ice during winter operations. If a passenger is caught due to a negligent door operation resulting from negligence of the operator, the respective monitoring functions of the apparatus (reversing) again automatically become effective after the operator's door command is released. Thus, the electronic device 24 operates as follows:

When the operator initiates an emergency reversing operation by depressing button 33, such signal is directed toward inlet 31 of the electronic device 24 to cause reversal of the direction of the door. Due to slowdown of the door, a reversing command appears at inlet 26, whereby the door is reversed into an opening direction. However, if a door command, maintained by the operator, is given at inlet 31, the reversing command is delayed in the monitoring logic device 42. If the operator ceases to maintain door command, such as by releasing an emergency door reversing push-button 33, before the door reaches limit switch 29, the control signal of the door valve 5 at outlet 36 is suppressed and the monitoring logic device 42 releases the reversing signal. Thus, the door is again opened via the control logic device 43, valve solenoid control 44, and outlet 34. As described above, the automatic operation may be overridden by the vehicle operator maintaining a door command via push-button 33.

The operating cycle for the door to open without encountering an obstruction is as follows: The driver operates the switch 33 connected to the inlet 31 of device 24; this signal passes the device 24 via decoder 40, control logic device 43, and valve solenoid control device 44 providing a signal at outlet 36; the door valve 5 changes its valve position; the respective pistons of cylinder 6 and 7 begin to move toward the open position (the left side as shown in FIG. 1); the limit switch 29 closes immediately; as the door reaches a fully open position limit switch 25 opens; and the pressure operated switches 15 and 18 have no contact. Similarly, if in the above opening operation an obstruction is encountered, the following occurs: when the door is stopped while traveling in an opening direction (assuming the obstruction is related to the door associated with cylinder 6), the pressure in chamber 9 rises; the switch 15 opens and the switch 16 closes; a plus signal is then sent through the closed limit switch 25, through switch 16 to solenoid 39 of valve 4; and valve 4 then changes position and the pressure in both operating cylinders 6 and 7 is vented. Similarly, if the door encounters an obstruction during closing after the operator has initiated a door closing by the switch 33 and electronic device 24 controlling valve 5 to pressurize cylinders 6 and 7 to move in a closing direction (the right side as shown in FIG. 1), the following occurs: as the respective pistons move to the right, limit switch 25 closes immediately, while switch 29 is still closed; the pressure in chamber 8 rises (again assuming the obstruction is related to the door associated with cylinder 6); switch 15 closes and switch 16 is opened by the pressure in chamber 8; via the still closed limit switch 29 and the switch 15, a plus signal is given to the inlet 26 of the electronic device 24; device 24 causes an output signal at outlet 36; and the valve 37 changes position thereby reversing the door movement to an opening direction.

Suppression of venting also occurs in case an obstacle interferes with opening movement of the door. If the door is opened by a signal at inlet 31, release of control of the door's rear edge is suppressed by monitoring logic device 42 until such a time that the door command occurs at inlet 31. Thus, the door can also be completely opened in case of hindering due to ice and snow, by maintained operating pressure on the push button 33. This can take place without venting of the door by the control apparatus. If the door command is terminated, the monitoring logic device 42 again releases the rear edge control and approaches the outlet 23 via the control logic device 43 and solenoid control device 44. If the end position is still not reached (limit switch 25 still closed) and if an obstacle is in the path of travel of the door, the door immediately becomes pressureless.

Having thus described the invention, what we claim as new and desire to secure by Letters Patent, is:

1. An electro-pneumatic door control apparatus for use on public vehicles for effecting reversal of door movement in the event of an obstruction in the path of movement of the door, said door control apparatus comprising:

(a) fluid pressure operable cylinder means operatively connected to a vehicle door for alternatively effecting opening and closing movements thereof, said cylinder means further comprising a pair of door-operating cylinders, each containing a pair of opposing chambers and a piston;

(b) solenoid-operated door valve means for reversing the fluid pressure supplied to said cylinder means;

(c) solenoid-operated supply valve means for alternatively effecting supply and release of fluid pressure to said door valve in response to respective first electrical signal or second electrical signal;

(d) electronic means connected to said solenoid-operated supply valve means for transmitting such first electrical signal to said solenoid-operated supply valve means for effecting operation thereof to supply fluid pressure to said solenoid-operated door means in response to an operator input, and for transmitting such second electrical signal to said solenoid-operated supply valve in response to sensing a door obstruction during a door-opening operation, said electronic means further having a signal decoder, a door position flip-flop device connected with said signal decoder for storing the respective door position, a monitoring logic device connected to said signal decoder and said door position flip-flop device, a control logic device connected to said signal decoder and said door position flip-flop and said monitoring logic device, and a valve solenoid control device connected to said control logic device without output end stages for transmitting electrical energy to said solenoid-operated door valve to properly connect the direction of fluid pressure to effect door opening or closing, and said electronic means having an inlet connected to the push button and two inlets connected to the reversing switches;

(e) a manually operable electric push button for manually effecting energization of said door valve;

(f) a manually operable emergency valve device to provide manual venting of said cylinders;

(g) a pair of reversing switches for evaluating the differential pressure in the cylinder chambers, thereby sensing obstructions on opening and closing;

(h) a pair of limit switches for determining respective end positions of door closed and open positions; and (i) said electronic means having suppressing means for suppressing a reversing signal transmitted to inlets of said electronic means connected to reversing switches by a control logic device when an operator-initiated door command exists at such inlet connected to said electric push button.

* * * * *